US008932433B2

(12) United States Patent
Sutman et al.

(10) Patent No.: US 8,932,433 B2
(45) **Date of Patent: *Jan. 13, 2015**

(54) RETENTION AND DRAINAGE IN THE MANUFACTURE OF PAPER

(75) Inventors: Frank J. Sutman, Wilmington, DE (US); John C. Harrington, Newark, DE (US); Robert A Gelman, Landenberg, PA (US)

(73) Assignee: Solenis Technologies, L.P. (CH)

( * ) Notice: Subject to any disclaimer, the term of this patent is extended or adjusted under 35 U.S.C. 154(b) by 0 days.

This patent is subject to a terminal disclaimer.

(21) Appl. No.: 13/551,202

(22) Filed: Jul. 17, 2012

(65) Prior Publication Data

US 2012/0291971 A1 Nov. 22, 2012

Related U.S. Application Data

(63) Continuation-in-part of application No. 12/437,887, filed on May 8, 2009, now Pat. No. 8,308,902, which is a continuation of application No. 11/313,561, filed on Dec. 21, 2005, now abandoned.

(60) Provisional application No. 60/640,167, filed on Dec. 29, 2004.

(51) Int. Cl.

| | |
|---|---|
| ***D21H 17/43*** | (2006.01) |
| ***D21H 17/56*** | (2006.01) |
| ***D21H 17/68*** | (2006.01) |
| ***D21H 21/10*** | (2006.01) |
| ***D21H 23/00*** | (2006.01) |
| ***C08L 39/02*** | (2006.01) |
| ***D21H 17/37*** | (2006.01) |
| ***D21H 17/36*** | (2006.01) |

(52) U.S. Cl.

CPC ..... *D21H 21/10* (2013.01); *D21H 17/375* (2013.01); *D21H 17/36* (2013.01); *D21H 17/37* (2013.01); *D21H 17/56* (2013.01); *D21H 17/68* (2013.01)

USPC ..... 162/167; 162/158; 162/164.1; 162/164.6; 162/166; 162/181.6; 524/500; 524/502; 524/505; 526/307.6

(58) Field of Classification Search

USPC ..... 162/158, 164.1, 164.6, 166, 167, 181.1, 162/168.1–168.3, 181.4–181.7, 183, 185; 106/400–1, 481, 482, 491; 524/500, 524/502, 505, 515, 543, 555–6; 526/72, 526/303.1, 307.4, 310, 307.6, 312, 317.1

See application file for complete search history.

(56) References Cited

U.S. PATENT DOCUMENTS

| | | | | |
|---|---|---|---|---|
| 4,749,444 | A * | 6/1988 | Lorz et al. | 162/168.3 |
| 5,167,766 | A * | 12/1992 | Honig et al. | 162/164.1 |
| 5,958,188 | A * | 9/1999 | Heard et al. | 162/168.2 |
| 6,083,348 | A * | 7/2000 | Auhorn et al. | 162/183 |
| 6,103,065 | A * | 8/2000 | Humphreys et al. | 162/181.8 |
| 6,315,866 | B1 * | 11/2001 | Sanchez | 162/168.2 |
| 8,308,902 | B2 * | 11/2012 | Sutman et al. | 162/168.3 |
| 8,480,853 | B2 * | 7/2013 | Ban | 162/168.1 |
| 2003/0192664 | A1 * | 10/2003 | Kulick et al. | 162/164.1 |
| 2004/0143039 | A1 * | 7/2004 | Hollomon et al. | 524/35 |

FOREIGN PATENT DOCUMENTS

WO WO 03/050152 * 6/2003

OTHER PUBLICATIONS

Hernandez-Barajas et al ("Inverse-emulsion polymerization of acrylamide using block copolymeric surfactants: mechanism, kinetics and modeling" Polymer, vol. 38, No. 2, 1997, pp. 437-447).*

* cited by examiner

*Primary Examiner* — Dennis Cordray

(74) *Attorney, Agent, or Firm* — Joanne Rossi; Michael J. Herman

(57) ABSTRACT

A method of improving retention and drainage in a papermaking process is disclosed. The addition of an associative polymer, a poly(vinylamine) and optionally a siliceous material to the papermaking slurry to improve retention and drainage is disclosed. Additionally a method to improve retention and drainage comprising addition of an organic microparticle, a poly(vinylamine) and optionally a siliceous material to the papermaking slurry is disclosed. A composition comprising an associative polymer, and a poly(vinylamine) and optionally further comprising cellulose fiber is disclosed.

11 Claims, No Drawings

RETENTION AND DRAINAGE IN THE MANUFACTURE OF PAPER

CROSS REFERENCE TO RELATED APPLICATIONS

This application is a continuation in part from U.S. application Ser. No. 12/437,887, filed May 8, 2009, which is a continuation in part from U.S. application Ser. No. 11/313,561, filed Dec. 21, 2005, the entire contents of which are herein incorporated by reference. U.S. Pat. No. 313,561 claims the benefit of U.S. Provisional Application No. 60/640,167, filed Dec. 29, 2004.

FIELD OF THE INVENTION

This invention relates to the process of making paper and paperboard from a cellulosic stock, employing a flocculating system.

BACKGROUND

Retention and drainage is an important aspect of papermaking. It is known that certain materials can provide improved retention and/or drainage properties in the production of paper and paperboard.

The making of cellulosic fiber sheets, particularly paper and paperboard, includes the following: 1) producing an aqueous slurry of cellulosic fiber which may also contain inorganic mineral extenders or pigments; 2) depositing this slurry on a moving papermaking wire or fabric; and 3) forming a sheet from the solid components of the slurry by draining the water.

The foregoing is followed by pressing and drying the sheet to further remove water. Organic and inorganic chemicals are often added to the slurry prior to the sheet-forming step to make the papermaking method less costly, more rapid, and/or to attain specific properties in the final paper product.

The paper industry continuously strives to improve paper quality, increase productivity, and reduce manufacturing costs. Chemicals are often added to the fibrous slurry before it reaches the papermaking wire or fabric to improve drainage/dewatering and solids retention; these chemicals are called retention and/or drainage aids.

Drainage or dewatering of the fibrous slurry on the papermaking wire or fabric is often the limiting step in achieving faster paper machine speeds. Improved dewatering can also result in a drier sheet in the press and dryer sections, resulting in reduced energy consumption. In addition, as this is the stage in the papermaking method that determines many of the sheet final properties, the retention/drainage aid can impact performance attributes of the final paper sheet.

With respect to solids, papermaking retention aids are used to increase the retention of fine furnish solids in the web during the turbulent method of draining and forming the paper web. Without adequate retention of the fine solids, they are either lost to the mill effluent or accumulate to high levels in the recirculating white water loop, potentially causing deposit buildup. Additionally, insufficient retention increases the papermakers' cost due to loss of additives intended to be adsorbed on the fiber. Additives can provide the opacity, strength, sizing or other desirable properties to the paper.

High molecular weight (MW) water-soluble polymers with either cationic or anionic charge have traditionally been used as retention and drainage aids. Recent development of inorganic microparticles, when used as retention and drainage aids, in combination with high MW water-soluble polymers, have shown superior retention and drainage efficacy compared to conventional high MW water-soluble polymers. U.S. Pat. Nos. 4,294,885 and 4,388,150 teach the use of starch polymers with colloidal silica, U.S. Pat. Nos. 4,643,801 and 4,750,974 teach the use of a coacervate binder of cationic starch, colloidal silica, and anionic polymer. U.S. Pat. No. 4,753,710 teaches flocculating the pulp furnish with a high MW cationic flocculant, inducing shear to the flocculated furnish, and then introducing bentonite clay to the furnish.

The efficacy of the polymers or copolymers used will vary depending upon the type of monomers from which they are composed, the arrangement of the monomers in the polymer matrix, the molecular weight of the synthesized molecule, and the method of preparation.

It had been found recently that water-soluble copolymers when prepared under certain conditions exhibit unique physical characteristics. These polymers are prepared without chemical cross linking agents. Additionally, the copolymers provide unanticipated activity in certain applications including papermaking applications such as retention and drainage aids. The anionic copolymers which exhibit the unique characteristics were disclosed in WO 03/050152 A1, the entire content of which is herein incorporated by reference. The cationic and amphoteric copolymers which exhibit the unique characteristics were disclosed in U.S. Ser. No. 10/728,145, the entire content of which is herein incorporated by reference.

The use of inorganic particles with linear copolymers of acrylamide, is known in the art. Recent patents teach the use of these inorganic particles with water-soluble anionic polymers (U.S. Pat. No. 6,454,902) or specific crosslinked materials (U.S. Pat. No. 6,454,902, U.S. Pat. No. 6,524,439 and U.S. Pat. No. 6,616,806).

However, there still exists a need to improve drainage and retention performance.

SUMMARY OF THE INVENTION

A method of improving retention and drainage in a papermaking process is disclosed. The method provides for the addition of an associative polymer and poly(vinylamine) to a papermaking slurry.

Additionally, a composition comprising an associative polymer, and a poly(vinylamine) and optionally further comprising cellulose fiber is disclosed.

Additionally, a composition comprising an associative polymer, poly(vinylamine), a siliceous material and optionally further comprising cellulose fiber is disclosed.

A method of improving retention and drainage in a papermaking process is disclosed. The method provides for the addition of an organic micropolymer and poly(vinylamine) to a papermaking slurry.

DETAILED DESCRIPTION OF THE INVENTION

The present invention provides for a synergistic combination comprising a water soluble copolymer prepared under certain conditions (hereinafter referred to as "associative polymer") and poly(vinylamine). It has surprising been found that this synergistic combination results in retention and drainage performance superior to that of the individual components. Synergistic effects occur when the combination of components are used together.

It has been found, unexpectedly, that the use of poly(vinylamine) in combination with associative polymers, such as the polymer disclosed in WO 03/050152 A1 or US 2004/0143039 A1, results in enhanced retention and drainage.

The present invention also provides for a composition comprising an associative polymer and poly(vinylamine)

The present invention also provides for a composition comprising an associative polymer, poly(vinylamine) and a siliceous material.

The present invention also provides for a composition comprising an associative polymer and poly(vinylamine) and cellulose fiber.

The present invention also provides for a composition comprising an associative polymer, poly(vinylamine), a siliceous material and cellulose fiber.

The present invention also provides for a composition comprising an organic microparticle and poly(vinylamine)

The use of multi-component systems in the manufacture of paper and paperboard provides the opportunity to enhance performance by utilizing materials that have different effects on the process and/or product. Moreover, the combinations may provide properties unobtainable with the components individually. Synergistic effects occur in the multi component systems of the present invention.

It is also observed that the use of the associative polymer as a retention and drainage aid has an impact on the performance of other additives in the papermaking system. Improved retention and/or drainage can have both a direct and indirect impact. A direct impact refers to the retention and drainage aid acting to retain the additive. An indirect impact refers to the efficacy of the retention and drainage aid to retain filler and fines onto which the additive is attached by either physical or chemical means. Thus, by increasing the amount of filler or fines retained in the sheet, the amount of additive retained is increased in a concomitant manner. The term filler refers to particulate materials, typically inorganic in nature, that are added to the cellulosic pulp slurry to provide certain attributes or be a lower cost substitute of a portion of the cellulose fiber. Their relatively small size, on the order of 0.2 to 10 microns, low aspect ratio and chemical nature results in their not being adsorbed onto the large fibers yet too small to be entrapped in the fiber network that is the paper sheet. The term "fines" refers to small cellulose fibers or fibrils, typically less than 0.2 mm in length and for ability to pass through a 200 mesh screen.

As the amount of the retention and drainage aid added to the paper making slurry increases the amount of additive retained in the sheet increases. This can provide either an enhancement of the property, providing a sheet with increased performance attribute, or allows the papermaker to reduce the amount of additive added to the system, reducing the cost of the product. Moreover, the amount of these materials in the recirculating water, or whitewater, used in the papermaking system is reduced. This reduced level of material, that under some conditions can be considered to be an undesirable contaminant, can provide a more efficient papermaking process or reduce the need for scavengers or other materials added to control the level of undesirable material.

One example of the reduced level of material is the reduction of ionic species present in the whitewater. Ionic species include salts, ionic polymers and polyelectrolytes. It is further comtemplated that the reduction in the level of ionic species in the whitewater will reduce fluctuations in the net charge of the papermaking system, improving the overall operation of the papermaking process.

The term additive, as used herein, refers to materials added to the paper slurry to provide specific attributes to the paper and/or improve the efficiency of the papermaking process. These materials include, but are not limited to, sizing agents, wet strength resins, dry strength resins, starch and starch derivatives, dyes, contaminant control agents, antifoams, and biocides.

The associative polymer useful in the present invention can be described as follows:

A water-soluble copolymer composition comprising the formula:

$$\text{+B-co-F+} \qquad \text{(I)}$$

wherein B is a nonionic polymer segment formed from the polymerization of one or more ethylenically unsaturated nonionic monomers; F is an anionic, cationic or a combination of anionic and cationic polymer segment(s) formed from polymerization of one or more ethylenically unsaturated anionic and/or cationic monomers; the molar % ratio of B:F is from 95:5 to 5:95; and the water-soluble copolymer is prepared via a water-in-oil emulsion polymerization technique that employs at least one emulsification surfactant consisting of at least one diblock or triblock polymeric surfactant wherein the ratio of the at least one diblock or triblock surfactant to monomer is at least about 3:100 and wherein; the water-in-oil emulsion polymerization technique comprises the steps of: (a) preparing an aqueous solution of monomers, (b) contacting the aqueous solution with a hydrocarbon liquid containing surfactant or surfactant mixture to form an inverse emulsion, (c) causing the monomer in the emulsion to polymerize by free radical polymerization at a pH range of from about 2 to less than 7.

The associative polymer can be an anionic copolymer. The anionic copolymer is characterized in that the Huggins' constant (k') determined between 0.0025 wt. % to 0.025 wt. % of the copolymer in 0.01M NaCl is greater than 0.75 and the storage modulus (G') for a 1.5 wt. % actives copolymer solution at 4.6 Hz greater than 175 Pa.

The associative polymer can be a cationic copolymer. The cationic copolymer is characterized in that its Huggins' constant (k') determined between 0.0025 wt. % to 0.025 wt. % of the copolymer in 0.01M NaCl is greater than 0.5; and it has a storage modulus (G') for a 1.5 wt. % actives copolymer solution at 6.3 Hz greater than 50 Pa.

The associative polymer can be an amphoteric copolymer. The amphoteric copolymer is characterized in that its Huggins' constant (k') determined between 0.0025 wt. % to 0.025 wt. % of the copolymer in 0.01M NaCl is greater than 0.5; and the copolymer has a storage modulus (G') for a 1.5 wt. % actives copolymer solution at 6.3 Hz greater than 50 Pa.

Inverse emulsion polymerization is a standard chemical process for preparing high molecular weight water-soluble polymers or copolymers. In general, an inverse emulsion polymerization process is conducted by 1) preparing an aqueous solution of the monomers, 2) contacting the aqueous solution with a hydrocarbon liquid containing appropriate emulsification surfactant(s) or surfactant mixture to form an inverse monomer emulsion, 3) subjecting the monomer emulsion to free radical polymerization, and, optionally, 4) adding a breaker surfactant to enhance the inversion of the emulsion when added to water.

Inverse emulsions polymers are typically water-soluble polymers based upon ionic or non-ionic monomers. Polymers containing two or more monomers, also referred to as copolymers, can be prepared by the same process. These co-monomers can be anionic, cationic, zwitterionic, nonionic, or a combination thereof.

Typical nonionic monomers, include, but are not limited to, acrylamide; methacrylamide; N-alkylacrylamides, such as N-methylacrylamide; N,N-dialkylacrylamides, such as N,N-dimethylacrylamide; methyl acrylate; methyl methacrylate;

acrylonitrile; N-vinyl methylacetamide; N-vinyl formamide; N-vinyl methyl formamide; vinyl acetate; N-vinyl pyrrolidone; hydroxyalky(meth)acrylates such as hydroxyethyl (meth)acrylate or hydroxypropyl(meth)acrylate; mixtures of any of the foregoing and the like.

Nonionic monomers of a more hydrophobic nature can also be used in the preparation of the associative polymer. The term 'more hydrophobic' is used here to indicate that these monomers have reduced solubility in aqueous solutions; this reduction can be to essentially zero, meaning that the monomer is not soluble in water. It is noted that the monomers of interest are also referred to as polymerizable surfactants or surfmers. These monomers include, but are not limited to, alkylacryamides; ethylenically unsaturated monomers that have pendant aromatic and alkyl groups, and ethers of the formula $CH_2{=}CR'CH_2OA_mR$ where R' is hydrogen or methyl; A is a polymer of one or more cyclic ethers such as ethyleneoxide, propylene oxide and/or butylene oxide; and R is a hydrophobic group; vinylalkoxylates; allyl alkoxylates; and allyl phenyl polyol ether sulfates. Exemplary materials include, but are not limited to, methylmethacrylate, styrene, t-octyl acrylamide, and an allyl phenyl polyol ether sulfate marketed by Clariant as Emulsogen APG 2019.

Exemplary anionic monomers include, but are not limited to, the free acids and salts of: acrylic acid; methacrylic acid; maleic acid; itaconic acid; acrylamidoglycolic acid; 2-acrylamido-2-methyl-1-propanesulfonic acid; 3-allyloxy-2-hydroxy-1-propanesulfonic acid; styrenesulfonic acid; vinylsulfonic acid; vinylphosphonic acid; 2-acrylamido-2-methylpropane phosphonic acid; mixtures of any of the foregoing and the like.

Exemplary cationic monomers include, but are not limited to, cationic ethylenically unsaturated monomers such as the free base or salt of: diallyldialkylammonium halides, such as diallyldimethylammonium chloride; the (meth)acrylates of dialkylaminoalkyl compounds, such as dimethylaminoethyl (meth)acrylate, diethylaminoethyl(meth)acrylate, dimethyl aminopropyl(meth)acrylate, 2-hydroxydimethyl aminopropyl(meth)acrylate, aminoethyl(meth)acrylate, and the salts and quaternaries thereof; the N,N-dialkylaminoalkyl(meth) acrylamides, such as N,N-dimethylaminoethylacrylamide, and the salts and quaternaries thereof and mixture of the foregoing and the like.

The co-monomers may be present in any ratio. The resultant associative polymer can be non-ionic, cationic, anionic, or amphoteric (contains both cationic and anionic charge).

The molar ratio of nonionic monomer to anionic monomer (B:F or Formula I) may fall within the range of 95:5 to 5:95, preferably the range is from about 75:25 to about 25:75 and even more preferably the range is from about 65:35 to about 35:65 and most preferably from about 60:40 to about 40:60. In this regard, the molar percentages of B and F must add up to 100%. It is to be understood that more than one kind of nonionic monomer may be present in the Formula I. It is also to be understood that more than one kind of anionic monomer may be present in the Formula I.

In one preferred embodiment of the invention the associative polymer, when it is an anionic copolymer, is defined by Formula I where B, the nonionic polymer segment, is the repeat unit formed after polymerization of acrylamide; and F, the anionic polymer segment, is the repeat unit formed after polymerization of a salt or free acid of acrylic acid and the molar percent ratio of B:F is from about 75:25 to about 25:75

The physical characteristics of the associative polymer, when it is an anionic copolymer, are unique in that their Huggins' constant (k') as determined in 0.01M NaCl is greater than 0.75 and the storage modulus (G') for a 1.5 wt. % actives polymer solution at 4.6 Hz is greater than 175 Pa, preferably greater than 190 and even more preferably greater than 205. The Huggins' constant is greater than 0.75, preferably greater than 0.9 and even more preferably greater than 1.0

The molar ratio of nonionic monomer to cationic monomer (B:F of Formula I) may fall within the range of 99:1 to 50:50, or 95:5 to 50:50, or 95:5 to 75:25, or 90:10 to 60:45, preferably the range is from about 85:15 to about 60:40 and even more preferably the range is from about 80:20 to about 50:50. In this regard, the molar percentages of B and F must add up to 100%. It is to be understood that more than one kind of nonionic monomer may be present in the Formula I. It is also to be understood that more than one kind of cationic monomer may be present in the Formula I.

With respect to the molar percentages of the amphoteric copolymers of Formula I, the minimum amount of each of the anionic, cationic and non-ionic monomer is 1% of the total amount of monomer used to form the copolymer. The maximum amount of the non-ionic, anionic or cationic is 98% of the total amount of monomer used to form the copolymer. Preferably the minimum amount of any of anionic, cationic and non-ionic monomer is 5%, more preferably the minimum amount of any of anionic, cationic and non-ionic monomer is 7% and even more preferably the minimum amount of any of anionic, cationic and non-ionic monomer is 10% of the total amount of monomer used to form the copolymer. In this regard, the molar percentages of anionic, cationic and non-ionic monomer must add up to 100%. It is to be understood that more than one kind of nonionic monomer may be present in the Formula I, more than one kind of cationic monomer may be present in the Formula I, and that more than one kind of anionic monomer may be present in the Formula I.

The physical characteristics of the associative polymer, when it is a cationic or amphoteric copolymer, are unique in that their Huggins' constant (k') as determined in 0.01M NaCl is greater than 0.5 and the storage modulus (G') for a 1.5 wt. % actives polymer solution at 6.3 Hz is greater than 50 Pa, preferably greater than 10 and even more preferably greater than 25, or greater than 50, or greater than 100, or greater than 175, or greater than 200. The Huggins' constant is greater than 0.5, preferably greater than 0.6, or greater than 0.75, or greater than 0.9 or greater than 1.0.

The emulsification surfactant or surfactant mixture used in an inverse emulsion polymerization system have an important effect on both the manufacturing process and the resultant product. Surfactants used in emulsion polymerization systems are known to those skilled in the art. These surfactants typically have a range of HLB (Hydrophilic Lipophilic Balance) values that is dependent on the overall composition. One or more emulsification surfactants can be used. The emulsification surfactant(s) of the polymerization products that are used to produce the associative polymer include at least one diblock or triblock polymeric surfactant. It is known that these surfactants are highly effective emulsion stabilizers. The choice and amount of the emulsification surfactant(s) are selected in order to yield an inverse monomer emulsion for polymerization. Preferably, one or more surfactants are selected in order to obtain a specific HLB value.

Diblock and triblock polymeric emulsification surfactants are used to provide unique materials. When the diblock and triblock polymeric emulsification surfactants are used in the necessary quantity, unique polymers exhibiting unique characteristic result, as described in WO 03/050152 A1 and US 2004/0143039 A1, the entire contents of each is herein incorporated by reference. Exemplary diblock and triblock polymeric surfactants include, but are not limited to, diblock and triblock copolymers based on polyester derivatives of fatty acids and poly[ethyleneoxide] (e.g., Hypermer® B246SF, Uniqema, New Castle, Del.), diblock and triblock copolymers based on polyisobutylene succinic anhydride and poly [ethyleneoxide], reaction products of ethylene oxide and propylene oxide with ethylenediamine, mixtures of any of the foregoing and the like. Preferably the diblock and triblock copolymers are based on polyester derivatives of fatty acids and poly[ethyleneoxide]. When a triblock surfactant is used, it is preferable that the triblock contains two hydrophobic regions and one hydrophilic region, i.e., hydrophobe-hydrophile-hydrophobe.

The amount (based on weight percent) of diblock or triblock surfactant is dependent on the amount of monomer used to form the associative polymer. The ratio of diblock or triblock surfactant to monomer is at least about 3 to 100. The amount of diblock or triblock surfactant to monomer can be greater than 3 to 100 and preferably is at least about 4 to 100 and more preferably 5 to 100 and even more preferably about 6 to 100. The diblock or triblock surfactant is the primary surfactant of the emulsification system.

A secondary emulsification surfactant can be added to ease handling and processing, to improve emulsion stability, and/or to alter the emulsion viscosity. Examples of secondary emulsification surfactants include, but are not limited to, sorbitan fatty acid esters, such as sorbitan monooleate (e.g., Atlas G-946, Uniqema, New Castle, Del.), ethoxylated sorbitan fatty acid esters, polyethoxylated sorbitan fatty acid esters, the ethylene oxide and/or propylene oxide adducts of alkylphenols, the ethylene oxide and/or propylene oxide adducts of long chain alcohols or fatty acids, mixed ethylene oxide/propylene oxide block copolymers, alkanolamides, sulfosuccinates and mixtures thereof and the like.

Polymerization of the inverse emulsion may be carried out in any manner known to those skilled in the art. Examples can be found in many references, including, for example, Allcock and Lampe, *Contemporary Polymer Chemistry*, (Englewood Cliffs, N.J., PRENTICE-HALL, 1981), chapters 3-5.

A representative inverse emulsion polymerization is prepared as follows. To a suitable reaction flask equipped with an overhead mechanical stirrer, thermometer, nitrogen sparge tube, and condenser is charged an oil phase of paraffin oil (135.0 g, Exxsol® D80 oil, Exxon—Houston, Tex.) and surfactants (4.5 g Atlas® G-946 and 9.0 g Hypermer® B246SF). The temperature of the oil phase is then adjusted to 37° C.

An aqueous phase is prepared separately which comprised 53-wt. % acrylamide solution in water (126.5 g), acrylic acid (68.7 g), deionized water (70.0 g), and Versenex® 80 (Dow Chemical) chelant solution (0.7 g). The aqueous phase is then adjusted to pH 5.4 with the addition of ammonium hydroxide solution in water (33.1 g, 29.4 wt. % as $NH_3$). The temperature of the aqueous phase after neutralization is 39° C.

The aqueous phase is then charged to the oil phase while simultaneously mixing with a homogenizer to obtain a stable water-in-oil emulsion. This emulsion is then mixed with a 4-blade glass stirrer while being sparged with nitrogen for 60 minutes. During the nitrogen sparge the temperature of the emulsion is adjusted to 50±1° C. Afterwards, the sparge is discontinued and a nitrogen blanket implemented.

The polymerization is initiated by feeding a 3-wt. % solution of 2,2'-azobisisobutyronitrile (AIBN) in toluene (0.213 g). This corresponds to an initial AIBN charge, as AIBN, of 250 ppm on a total monomer basis. During the course of the feed the batch temperature was allowed to exotherm to 62° C. (~50 minutes), after which the batch was maintained at 62±1° C. After the feed the batch was held at 62±1° C. for 1 hour. Afterwards 3-wt. % AIBN solution in toluene (0.085 g) is then charged in under one minute. This corresponds to a second AIBN charge of 100 ppm on a total monomer basis. Then the batch is held at 62±1° C. for 2 hours. Then batch is then cooled to room temperature, and breaker surfactant(s) is added.

The associative polymer emulsion is typically inverted at the application site resulting in an aqueous solution of 0.1 to 1% active copolymer. This dilute solution of the associative polymer is then added to the paper process to affect retention and drainage. The associative polymer may be added to the thick stock or thin stock, preferably the thin stock. The associative polymer may be added at one feed point, or may be split fed such that the associative polymer is fed simultaneously to two or more separate feed points. Typical stock addition points include feed point(s) before the fan pump, after the fan pump and before the pressure screen, or after the pressure screen.

The associative polymer may be added in any effective amount to achieve flocculation. The amount of copolymer could be more than 0.5 Kg per metric ton of cellulosic pulp (dry basis). Preferably, the associative polymer is employed in an amount of at least about 0.03 lb. to about 0.5 Kg. of active copolymer per metric ton of cellulosic pulp, based on the dry weight of the pulp. The concentration of copolymer is preferably from about 0.05 to about 0.5 Kg of active copolymer per metric ton of dried cellulosic pulp. More preferably the copolymer is added in an amount of from about 0.05 to 0.4 Kg per metric ton cellulose pulp and, most preferably, about 0.1 to about 0.3 Kg per metric ton based on dry weight of the cellulosic pulp.

The second component of the retention and drainage system is poly(vinylamine), a cationic polymer. Poly(vinylamine) can be a homopolymer or a copolymer containing one or more ethylenically unsaturated monomers wherein the final product contains amine moieties. It is typically prepared by polymerization of the monomer(s) followed by hydrolysis. The level of hydrolysis can be expressed as "% hydrolysis" or "hydrolysis %" on a molar basis. A hydrolyzed polymer can thus be described by as "% hydrolyzed." Moreover the level of hydrolysis can be approximated. For the purposes of applicants' invention, a poly(vinylamine) that is referred to as "50% hydrolyzed" means from 40 to 60% hydrolyzed. Likewise, a poly(vinylamine) that is about 100% hydrolyzed means from 80 to 100% hydrolyzed. The hydrolysis reaction results in the conversion of some or all of the monomer(s) to amines, as controlling the hydrolysis reaction can vary the resultant percentage of monomers having amine functionality. Examples of monomers used to make a poly(vinylamine) include, but are not limited to, N-vinylformamide, N-vinyl methyl formamide, N-vinylphthalimide, N-vinylsuccinimide, N-vinyl-t-butylcarbamate, N-vinylacetamide, and mixtures of any of the foregoing and the like. In the case of copolymers, nonionic monomers, such as those described above, are the preferred comonomers.

Alternatively, poly(vinylamine) can be prepared by the derivatization of a polymer. Examples of this process include, but are not limited to, the Hofmann reaction of polyacrylamide. It is comtemplated that other synthetic routes to a poly(vinylamine) or polyamine can be utilized.

Preferred poly(vinylamine) materials are those prepared by the polymerization of N-vinylformamide followed by hydrolysis of some or all of the formamide moieties to amines. The polymer can be a homopolymer of N-vinylformamide or a copolymer containing one or more ethylenically unsaturated monomers. The material can be hydrolyzed using either acidic or basic conditions; basic is preferred. Controlling the hydrolysis reaction can vary the resultant percentage of monomers having amine functionality.

Poly(vinylamine) can also be used to provide other enhancements to the papermaking process and performance attributes of the sheet. As an example, the dry strength of paper is enhanced by the use of poly(vinylamine).

It is contemplated that the combined use of the associative polymer and the poly(vinylamine) can provide enhancement of other performance attributes provided by the poly(vinylamine). Without wishing to be bound by theory, this unexpected result may be a consequence of improved retention but, alternatively, can be a result of a synergistic interaction. Without wishing to be bound by theory, it is believed that the associative polymer interacts with the poly(vinylamine) resulting in an intermolecular complex mediated by electrostatic interactions. The intermolecular complex may provide improved retention and/or other physical properties to the paper and paper board. One example of these intermolecular complexes is a coacervate.

The second component of the retention and drainage system can be added at amounts up to 5.0 Kg of active material per metric ton of cellulose pulp based on dry weight of the pulp, preferably up to 1.0 kg per metric ton of cellulose pulp, even more preferably up to 0.5 kg per metric ton of cellulose pulp. The second component can be added in amounts above 0.05 Kg of active material per metric ton of cellulose pulp based on dry weight of the pulp, preferably in amount above 0.1 kg per metric ton of cellulose pulp. The ratio of the associative polymer to second component (poly(vinylamine)) can be 1:100 to 100:1, preferably 1:50 to 50:1, or 1:20 to 20:1, or 1:10 to 10:1 or 2:1 to 1:10.

Optionally siliceous materials can be used as an additional component of a retention and drainage aid used in making paper and paperboard. The siliceous material may be any of the materials selected from the group consisting of silica based particles, silica microgels, amorphous silica, colloidal silica, anionic colloidal silica, silica sols, silica gels, polysilicates, polysilicic acid, and the like. These materials are characterized by the high surface area, high charge density and submicron particle size.

This group includes stable colloidal dispersion of spherical amorphous silica particles, referred to in the art as silica sols. The term sol refers to a stable colloidal dispersion of spherical amorphous particles. Silica gels are three dimensional silica aggregate chains, each comprising several amorphous silica sol particles, that can also be used in retention and drainage aid systems; the chains may be linear or branched. Silica sols and gels are prepared by polymerizing monomeric silicic acid into a cyclic structure that result in discrete amorphous silica sols of polysilicic acid. These silica sols can be reacted further to produce a three dimensional gell network. The various silica particles (sols, gels, etc.) can have an overall size of 5-50 nm. Anionic colloidal silica can also be used.

The amount of siliceous material in relationship to the amount of associative polymer used in the present invention can be about 100:1 to about 1:100 by weight, or from about 50:1 to 1:50 or about 10:1 to 1:10.

Optionally, an additional component of the retention and drainage aid system can be a conventional flocculant. A conventional flocculant is generally a linear cationic or anionic copolymer of acrylamide. The additional component of the retention and drainage system is added in conjunction with the aluminum compound and the associative polymer to provide a multi-component system which improves retention and drainage.

The conventional flocculant can be an anionic, cationic or non-ionic polymer. The ionic monomers are most often used to make copolymers with a non-ionic monomer such as acrylamide. These polymers can be provided by a variety of synthetic processes including, but not limited to, suspension, dispersion and inverse emulsion polymerization. For the last process, a microemulsion may also be used.

The co-monomers of the conventional flocculant may be present in any ratio. The resultant copolymer can be non-ionic, cationic, anionic, or amphoteric (contains both cationic and anionic charge).

Yet other additional components that can be part of the inventive system are aluminum sources, such as alum (aluminum sulfate), polyaluminum sulfate, polyaluminum chloride and aluminum chlorohydrate.

Another embodiment of the invention is the use of organic microparticle (also know as a micropolymer or a microbead) as a full or partial substitute for the associative polymer in conjunction with the poly(vinylamine) materials described above. An example of a microparticle is disclosed in U.S. Pat. No. 5,171,808 and in U.S. Pat. No. 5,167,766.

For the purpose of this invention the words microparticle, micropolymer or microbead will be used interchangably. Organic microparticles are crosslinked, ionic, organic polymeric materials. They are copolymers of a nonionic monomer, an ionic monomer and a crosslinking agent. Further, the ionic monomer may be anionic or cationic. Use of both anionic and cationic monomers in the same polymer results in an amphoteric material. The microparticles are typically formed by the polymerization of ethylenically unsaturated monomers that can be anionic, cationic or non-ionic. Inverse emulsion polymerization is typically used to prepare these materials although other polymerization methods known to those skilled in the art can be used.

The preferred ethylenically unsaturated non-ionic monomers in preparing the microparticle are selected from acrylamide; methacrylamide; N,N-dialkylacrylamides; N-alkylacrylamides; N-vinyl methacetamide; N-vinyl methylformamide; N-vinyl pyrrolidone; and mixtures thereof.

The preferred anionic monomers used in preparing the microparticle are selected from include, but are not limited to, acrylic acid, methacrylic acid, 2-acrylamido-2-alkylsulfonic acids where the alkyl group contains 1 to 6 carbon atoms, such as 2-acrylamido-2-propane-sulfonic acid or mixtures of any of the foregoing and the like; and their alkaline salts. Especially preferred are the salts or acids of acrylic acid, methacrylic acid, and 2-acrylamido-2-methylpropane sulfonic acid. The preferred salts have sodium as the cation The cationic monomers that comprise the microparticle include, but are not limited to ethylenically unsaturated monomers selected from, the free base or salts of: acryloxyethyltrimethylammonium chloride; diallydimethylammonium chloride; 3-(meth)acrylamido-propyltrimethylammonium chloride; 3-acrylamido-propyltrimethylammonium-2-hydroxypropylacrylate methosulfate; trimethylammoniumethyl methacrylate methosulfate; 1-trimethylammonium-2-hydroxypropyl-methacrylate methosulfate; methacryloxyethyltri-methylammonium chloride; and mixtures of any of the foregoing and the like.

These ethylenically unsaturated anionic, cationic and non-ionic monomers that make up the microparticle may be polymerized to form anionic, cationic or amphoteric copolymers, with the three types of monomer present in any ratio. Acrylamide is the preferred nonionic monomer.

Polymerization of the monomers is conducted in the presence of a polyfunctional crosslinking agent to form the crosslinked composition. The polyfunctional crosslinking agent comprises molecules that have at least two double bonds, or a double bond and reactive group, or two reactive groups. Examples of the polyfunctional cross-linking agent containing at least two double bonds include, but are not limited to N,N-methylenebisacrylamide, N,N-methylenebismethacrylamide, polyethyleneglycol diacrylate, polyethyleneglycol dimethacrylate, N-vinyl acrylamide, divinylbenzene, triallylammonium salts, N-methyallylacrylamide and the like. Examples of the polyfunctional cross-linking or branching agent containing at least one double bond and at least one reactive group include, but are not limited to, glycidyl acrylate, acrolein, methylolacrylamide and the like. Examples of the polyfunctional branching agents containing at least two reactive groups include, but are not limited to, aldehydes such as glyoxal, diepoxy compounds, epichlorohydrin and the like. Crosslinking agents are to be used in sufficient quantities to assure a crosslinked composition.

An example of a microparticle is disclosed in U.S. Pat. No. 5,171,808 and in U.S. Pat. No. 5,167,766. Microparticles are commercially available under the trade name Polyflex® CP.3 (Ciba, Tarrytown, N.Y.).

The components of a retention and drainage system may be added substantially simultaneously to the cellulosic suspension. The term retention and drainage system is used here to encompass two or more distinct materials added to the papermaking slurry to provide improved retention and drainage. For instance, the components may be added to the cellulosic suspension separately either at the same stage or dosing point or at different stages or dosing points. When the components of the inventive system are added simultaneously any two of more of the materials may be added as a blend. The mixture may be formed in-situ by combining the materials at the dosing point or in the feed line to the dosing point. Alternatively the inventive system comprises a preformed blend of the materials. In an alternative form of the invention the components of the inventive system are added sequentially. A shear point may or may not be present between the addition points of the components. The components can be added in any order.

The inventive system is typically added to the paper process to affect retention and drainage. The inventive system may be added to the thick stock or thin stock, preferably the thin stock. The system may be added at one feed point, or may be split fed such that the inventive system is fed simultaneously to two or more separate feed points. Typical stock addition points include feed points(s) before the fan pump, after the fan pump and before the pressure screen, or after the pressure screen.

EXAMPLES

To evaluate the performance of the present invention, a series of drainage tests were conducted utilizing a synthetic alkaline furnish. This furnish is prepared from hardwood and softwood dried market lap pulps, and from water and further materials. First, the hardwood and softwood dried market lap pulp are refined separately. These pulps are then combined at a ratio of about 70 percent by weight of hardwood to about 30 percent by weight of softwood in an aqueous medium. The aqueous medium utilized in preparing the furnish comprises a mixture of local hard water and deionized water to a representative hardness. Inorganic salts are added in amounts so as to provide this medium with a total alkalinity of 75 ppm as $CaCO_3$ and hardness of 100 ppm as $CaCO_3$. Precipitated calcium carbonate (PCC) is introduced into the pulp furnish at a representative weight percent to provide a final furnish containing 80% fiber and 20% PCC filler. The drainage tests were conducted by mixing the furnish with a mechanical mixer at a specified mixer speed, and introducing the various chemical components into the furnish and allowing the individual components to mix for a specified time prior to the addition of the next component. The specific chemical components and dosage levels are described in the data tables. The drainage activity of the invention was determined utilizing the Canadian Standard Freeness (CSF). The CSF test, a commercially available device (Lorentzen & Wettre, Stockholm, Sweden) can be utilized to determine relative drainage rate or dewatering rate is also known in the art; standard test method (TAPPI Test Procedure T-227) is typical. The CSF device consists of a drainage chamber and a rate measuring funnel, both mounted on a suitable support. The drainage chamber is cylindrical, fitted with a perforated screen plat and a hinged plate on the bottom, and with a vacuum tight hinged lid on the top. The rate-measuring funnel is equipped with a bottom orifice and a side, overflow orifice.

The CSF drainage tests are conducted with 1 liter of the furnish. The furnish is prepared for the described treatment externally from the CSF device in a square beaker to provide turbulent mixing. Upon completion of the addition of the additives and the mixing sequence, the treated furnish is poured into the drainage chamber, closing the top lid, and them immediately opening the bottom plate. The water is allowed to drain freely into the rate-measuring funnel; water flow that exceeds that determined by the bottom orifice will overflow through the side orifice and is collected in a graduated cylinder. The values generated are described in milliliters (ml) of filtrate; higher quantitative values represent higher levels of drainage or dewatering.

Table 1 (below) illustrates the utility of the invention. The test samples were prepared as follows: the furnish prepared as described above is added, first, 5 kg of cationic starch (Stalok® 400, AE., Staley, Decatur, Ill.) per metric ton of furnish (dry basis). Next, when used (as indicated in the table), 0.5 kg poly(vinylamine) (PPD M-1188, Hercules Incorporated, Wilmington, Del.) per metric ton of furnish (dry basis) is added. Next, 0.25 kg of PerForm® PC8138 cationic polymer (Hercules Incorporated, Wilmington, Del.) per metric ton of furnish is added. Then, the additive(s) of interest is added. The following additives as listed in Table 1 were used at a level of 0.25 kg per metric ton of furnish: SP9232 is PerForm® SP9232, a retention and drainage aid (see PCT WO 03/050152 A), (Hercules Incorporated, Wilmington, Del.); silica is NP 780, a product of Eka Chemicals, Marietta, Ga.

PPD M-1188 is a hydrolyzed poly(vinylamine) prepared from N-vinylformamide. Perform™ SP9232 is a water-soluble anionic copolymer of acrylamide and acrylic acid whose preparation is described in PCT WO 03/050152.

TABLE 1

| Example | Additives | PVam Added[a] | Addition Scheme[b] | CSF Freeness (ml) |
|---|---|---|---|---|
| 1 | None | No | — | 426 |
| 2 | None | Yes | — | 427 |
| 3 | SP9232 | No | — | 546 |
| 4 | Silica | No | — | 625 |
| 5 | SP9232 | Yes | SIM | 704 |
| 6 | Silica/SP9232 | No | SIM | 635 |
| 7 | Silica/SP9232 | Yes | SIM | 714 |
| 8 | SP9232 | Yes | SEQ | 710 |
| 9 | Silica/SP9232 | Yes | SEQ | 738 |

[a]Indicates that poly(vinylamine) was used (yes) or not used (no) in the example.
[b]Indicates, for multiple additives, whether the addition was simultaneous (SIM) or sequential (SEQ)

These data indicate that while poly(vinylamine), alone, does not improve drainage (Example 2), it provided a synergistic increase in drainage with PerForm® SP9232 (Example 5). Furthermore, poly(vinylamine) provides a synergistic increase when PerForm® SP9232 is used in combination with silica. Finally, sequential addition of silica and PerForm® SP9232 is preferred, although simultaneous addition results in acceptable performance.

Furnish was again prepared as described in Experiment 1. The drainage tests were conducted by mixing the furnish with a mechanical mixer at 1200 rpm, and introducing the various chemical components into the furnish and allowing the individual components to mix for 10 seconds prior to the addition of the next component. The specific chemical components and dosage levels are described in Table 2 (below).

The drainage activity of the invention was determined utilizing a modification of the Dynamic Drainage Analyzer, test equipment available from AB Akribi Kemikonsulter, Sundsvall, Sweden. The test device applies a 300 mbar vacuum to the bottom of the separation medium. The device electronically measures the time between the application of vacuum and the vacuum break point, i.e.—the time at which the air/water interface passes through the thickening fiber mat. It reports this value as the drainage time. A lower drainage time is preferred. The modification consists of substituting a mixing chamber and filtration medium with both smaller sample volume and cross-sectional area to the machine. Thus, a 250-ml sample volume at 0.5% consistency and a 47-mm cross-sectional filtration diameter (60-mesh screen) were used for all tests.

The test samples were prepared as follows: the furnish prepared as described above is added, followed by 5 kg of cationic starch (Stalok™ 400, Tate and Lyle, Decatur, Ill.) per metric ton of furnish (dry basis). Then, as indicated in the table, between 0.5 and 10 kg/metric ton of polyvinylamine is added. The 30%, 50%, and 100% hydrolyzed polyvinylamine products have trade names of Hercobond™ 6330, 6350, and 6363, respectively (Hercules Incorporated, Wilmington, Del.). Next, 0.2 kg/metric ton of Perform™ SP7200 (Hercules Incorporated, Wilmington, Del.) is added. Either 0.2 kg/metric ton of associative polymer or 0.2 kg/metric ton of associative polymer and 0.2 kg/metric ton of Perform™ PM 9025 silica (Hercules Incorporated, Wilmington, Del.) are added as shown in Table 2, Each addition step is allowed to mix for 10 seconds at 1200 rpm. At the completion of all additions, the drainage event commences.

Perform™ SP7200 is a water-soluble anionic copolymer of acrylamide and acrylic acid, similar to Perform™ SP9232.

As can be seen from the results of Table 2, it has been surprisingly discovered that particular proportions of polyvinylamine to associative polymer improve drainage over associative polymer alone. A composition with high proportion of polyvinylamine causes drainage performance to deteriorate relative to the associative polymer alone. This is also true when silica is included.

Polyvinylamine that has been 30% hydrolyzed yields superior drainage results at a ratio, by mass, to the associative co-polymer Perform™ SP7200 of between about 0.5:1 and 10:1 when used without silica and about 0.5:1 and 10:1 with silica.

Polyvinylamine that has been 50% hydrolyzed yields superior drainage results at a ratio, by mass, to the associative co-polymer Perform™ SP7200 of between about 0.5:1 and 10:1 when used without silica and about 0.5:1 and 10:1 with silica.

Polyvinylamine that has been 100% hydrolyzed yields superior drainage results at a ratio, by mass, to the associative co-polymer Perform™ SP7200 of between about 0.5:1 and 10:1 when used without silica and about 0.5:1 and 10:1 with silica.

| ADD # 1: RUN # | 5 Kg#/T Stalok 400 ADD # 2: | kg/T (active) | ADD # 3 | kg/T (active) | Ratio PVAM: Associative Polymer | ADD # 3 | kg/T (active) | VDT Drain time, s |
|---|---|---|---|---|---|---|---|---|
| 1 | SP 7200 | 0.2 | SP 7200 | 0.2 | | | | 54.6 |
| 2 | PVAm - 30% hydrolyzed | 0.1 | SP 7200 | 0.2 | 0.5 | | | 34.3 |
| 3 | PVAm - 30% hydrolyzed | 0.2 | SP 7200 | 0.2 | 1 | | | 23.3 |
| 4 | PVAm - 30% hydrolyzed | 0.4 | SP 7200 | 0.2 | 2 | | | 17.9 |
| 5 | PVAm - 30% hydrolyzed | 1 | SP 7200 | 0.2 | 5 | | | 25.1 |
| 6 | PVAm - 30% hydrolyzed | 2 | SP 7200 | 0.2 | 10 | | | 37.9 |
| 8 | PVAm - 50% hydrolyzed | 0.1 | SP 7200 | 0.2 | 0.5 | | | 34.0 |
| 9 | PVAm - 50% hydrolyzed | 0.2 | SP 7200 | 0.2 | 1 | | | 24.1 |
| 10 | PVAm - 50% hydrolyzed | 0.4 | SP 7200 | 0.2 | 2 | | | 19.7 |
| 11 | PVAm - 50% hydrolyzed | 1 | SP 7200 | 0.2 | 5 | | | 29.8 |
| 12 | PVAm - 50% hydrolyzed | 2 | SP 7200 | 0.2 | 10 | | | 40.9 |
| 14 | PVAm - 100% hydrolyzed | 0.1 | SP 7200 | 0.2 | 0.5 | | | 32.6 |
| 15 | PVAm - 100% hydrolyzed | 0.2 | SP 7200 | 0.2 | 1 | | | 22.6 |
| 16 | PVAm - 100% hydrolyzed | 0.4 | SP 7200 | 0.2 | 2 | | | 17.7 |
| 17 | PVAm - 100% hydrolyzed | 1 | SP 7200 | 0.2 | 5 | | | 26.1 |
| 18 | PVAm - 100% hydrolyzed | 2 | SP 7200 | 0.2 | 10 | | | 36.2 |
| 20 | PVAm - 30% hydrolyzed | 0.1 | SP 7200 | 0.2 | 0.5 | PM 9025 silica | 0.2 | 30.2 |
| 21 | PVAm - 30% hydrolyzed | 0.2 | SP 7200 | 0.2 | 1 | PM 9025 silica | 0.2 | 21.0 |
| 22 | PVAm - 30% hydrolyzed | 0.4 | SP 7200 | 0.2 | 2 | PM 9025 silica | 0.2 | 18.7 |
| 23 | PVAm - 30% hydrolyzed | 1 | SP 7200 | 0.2 | 5 | PM 9025 silica | 0.2 | 24.5 |
| 24 | PVAm - 30% hydrolyzed | 2 | SP 7200 | 0.2 | 10 | PM 9025 silica | 0.2 | 32.1 |
| 25 | PVAm - 50% hydrolyzed | 0.1 | SP 7200 | 0.2 | 0.5 | PM 9025 silica | 0.2 | 29.8 |
| 26 | PVAm - 50% hydrolyzed | 0.2 | SP 7200 | 0.2 | 1 | PM 9025 silica | 0.2 | 23.8 |
| 27 | PVAm - 50% hydrolyzed | 0.4 | SP 7200 | 0.2 | 2 | PM 9025 silica | 0.2 | 19.0 |
| 28 | PVAm - 50% hydrolyzed | 1 | SP 7200 | 0.2 | 5 | PM 9025 silica | 0.2 | 27.6 |
| 29 | PVAm - 50% hydrolyzed | 2 | SP 7200 | 0.2 | 10 | PM 9025 silica | 0.2 | 37.8 |
| 30 | PVAm - 100% hydrolyzed | 0.1 | SP 7200 | 0.2 | 0.5 | PM 9025 silica | 0.2 | 29.8 |
| 31 | PVAm - 100% hydrolyzed | 0.2 | SP 7200 | 0.2 | 1 | PM 9025 silica | 0.2 | 20.7 |
| 32 | PVAm - 100% hydrolyzed | 0.4 | SP 7200 | 0.2 | 2 | PM 9025 silica | 0.2 | 17.5 |
| 33 | PVAm - 100% hydrolyzed | 1 | SP 7200 | 0.2 | 5 | PM 9025 silica | 0.2 | 22.5 |
| 34 | PVAm - 100% hydrolyzed | 2 | SP 7200 | 0.2 | 10 | PM 9025 silica | 0.2 | 30.4 |

The invention claimed is:

1. A method of improving retention and drainage in a papermaking process comprising: adding to a papermaking slurry, a water soluble anionic associative polymer and a poly(vinylamine) in a ratio of from 2:1 to 1:10 by mass, wherein the associative polymer comprises the formula:

$$+B\text{-co-}F+ \quad (I)$$

wherein B is a nonionic polymer segment comprising one or more ethylenically unsaturated nonionic monomers; F is an polymer segment comprising at least one ethylenically unsaturated anionic monomer; and the molar percent ratio of B:F is 95:5 to 5:95 and wherein the associative polymer has associative properties provided by an effective amount of at least one emulsification surfactant comprising a triblock polymeric surfactants, and wherein the amount of the at least one triblock surfactant to monomer is at least about 3:100, wherein the poly(vinylamine) is from 30 to 100% hydrolyzed and wherein non-ionic monomer comprises acrylamide and the anionic monomer comprises a free acid or salt of acrylic acid.

2. The method of claim 1 further comprising adding a siliceous material.

3. The method of claim 2 wherein the siliceous material is selected from the group consisting of silica based particles, silica microgels, amorphous silica, colloidal silica, anionic colloidal silica, silica sols, silica gels, polysilicates, polysilicic acid, and combinations thereof.

4. The method of claim 1 wherein the poly(vinylamine) and associative polymer are added to the papermaking slurry as a blend, simultaneously or sequentially.

5. The method of claim 1 wherein the amount of poly(vinyl amine) is up to 5.0 Kg of active material per metric ton of cellulose pulp based on dry weight of the pulp.

6. The method of claim 1 wherein the amount of poly(vinyl amine) is from about 0.05 kg to about 1.0 Kg of active material per metric ton of cellulose pulp based on dry weight of the pulp.

7. A composition comprising a water soluble associative polymer and poly(vinylamine) in a ratio of from 2:1 to 1:10 by mass, wherein the associative polymer comprises the formula:

$$+B\text{-co-}F+ \quad (I)$$

wherein B is a nonionic polymer segment comprising one or more ethylenically unsaturated nonionic monomers; F is an polymer segment comprising at least one ethylenically unsaturated anionic monomer; and the molar percent ratio of B:F is 95:5 to 5:95 and wherein the associative polymer has associative properties provided by an effective amount of at least one emulsification surfactant comprising a triblock polymeric surfactants, and wherein the amount of the at least one triblock surfactant to monomer is at least about 3:100, wherein the poly(vinylamine) is from 30 to 100% hydrolyzed and wherein non-ionic monomer comprises acrylamide and the anionic monomer comprises a free acid or salt of acrylic acid.

8. The composition of claim 7 further comprising a siliceous material.

9. The composition of claim 7 further comprising cellulosic fiber.

10. The composition of claim 9 further comprising a siliceous material.

11. A method for making paper with a reduced level of ionic species in the whitewater comprising adding a water soluble associative polymer and a poly(vinylamine) to a paper making slurry in a ratio of from 2:1 to 1:10 by mass, wherein the associative polymer comprises the formula:

$$+B\text{-co-}F+ \quad (I)$$

wherein B is a nonionic polymer segment comprising one or more ethylenically unsaturated nonionic monomers; F is an polymer segment comprising at least one ethylenically unsaturated anionic monomer; and the molar percent ratio of B:F is 95:5 to 5:95 and wherein the associative polymer has associative properties provided by an effective amount of at least one emulsification surfactant comprising a triblock polymeric surfactants, and wherein the amount of the at least one triblock surfactant to monomer is at least about 3:100, wherein the poly(vinylamine) is from 30 to 100% hydrolyzed and wherein non-ionic monomer comprises acrylamide and the anionic monomer comprises a free acid or salt of acrylic acid.

* * * * *